US006920230B2

(12) United States Patent
Usuki et al.

(10) Patent No.: US 6,920,230 B2
(45) Date of Patent: Jul. 19, 2005

(54) ELECTROMAGNETIC TRANSDUCER AND PORTABLE COMMUNICATION DEVICE

(75) Inventors: Sawako Usuki, Hyogo (JP); Shuji Saiki, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 567 days.

(21) Appl. No.: 09/980,325

(22) PCT Filed: Apr. 16, 2001

(86) PCT No.: PCT/JP01/03256

§ 371 (c)(1),
(2), (4) Date: Nov. 30, 2001

(87) PCT Pub. No.: WO01/91514

PCT Pub. Date: Nov. 29, 2001

(65) Prior Publication Data

US 2002/0136424 A1 Sep. 26, 2002

(30) Foreign Application Priority Data

May 22, 2000 (JP) ..... 2000-149353

(51) Int. Cl.[7] ..... H04R 25/00

(52) U.S. Cl. ..... 381/396; 381/431; 381/412; 381/414; 381/429; 181/163; 181/164; 181/168

(58) Field of Search ..... 455/128, 347, 455/350, 349, 567, 575.1; 381/189, 394, 395, 396, 412, 398, 391, 424, 423, 429, 431, 414, FOR 154, 152; 340/391.1, 384.1

(56) References Cited

U.S. PATENT DOCUMENTS

| | | | | | |
|---|---|---|---|---|---|
| 4,829,581 | A | * | 5/1989 | Nieuwendijk et al. | 381/398 |
| 5,125,033 | A | * | 6/1992 | Lee | 381/333 |
| 5,218,337 | A | * | 6/1993 | Peter | 340/388.1 |
| 6,449,376 | B1 | * | 9/2002 | Beltran et al. | 381/423 |
| 6,600,400 | B1 | * | 7/2003 | Andou et al. | 335/252 |
| 6,658,133 | B1 | * | 12/2003 | Saiki et al. | 381/417 |
| 6,671,383 | B2 | * | 12/2003 | Usuki et al. | 381/396 |
| 6,850,138 | B1 | * | 2/2005 | Sakai | 335/222 |

FOREIGN PATENT DOCUMENTS

| | | |
|---|---|---|
| JP | 49-76732 | 5/1974 |
| JP | 8-79890 | 3/1996 |

* cited by examiner

*Primary Examiner*—Curtis Kuntz
*Assistant Examiner*—Dionne Harvey
(74) *Attorney, Agent, or Firm*—RatnerPrestia

(57) ABSTRACT

An electromagnetic transducer includes: a first diaphragm; a second diaphragm provided in a central portion of the first diaphragm, the second diaphragm comprising a magnetic material having a first opening in a central portion thereof; a yoke disposed so as to oppose the first diaphragm; a center pole disposed between the yoke and the first diaphragm, wherein the center pole has a shape which allows insertion into the first opening; a coil disposed so as to surround the center pole; and a first magnet disposed so as to surround the coil.

44 Claims, 13 Drawing Sheets

PRIOR ART

*FIG. 13* PRIOR ART
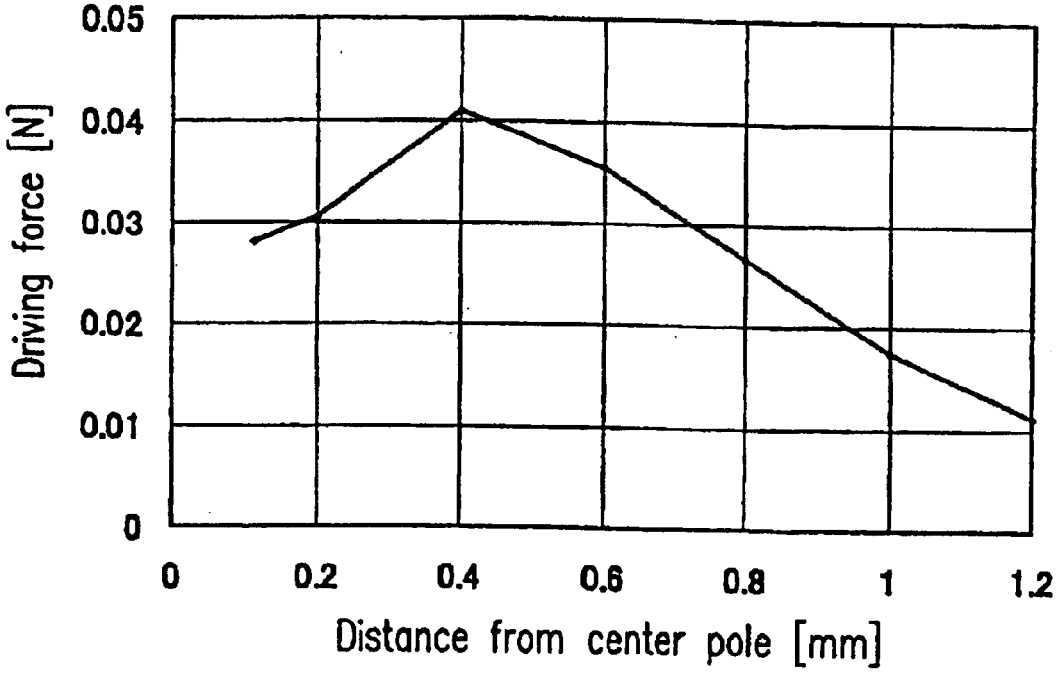

ELECTROMAGNETIC TRANSDUCER AND PORTABLE COMMUNICATION DEVICE

This application is a U.S. National Phase application of PCT International Application PCT/JP01/03256.

TECHNICAL FIELD

The present invention relates to an electroacoustic transducer for use in a portable communication device, e.g., a cellular phone or a pager, for reproducing an alarm sound or melody sound responsive to a received call and for reproducing voices and the like.

BACKGROUND ART

FIGS. 12A and 12B show a plan view and a cross-sectional view, respectively, of a conventional electroacoustic transducer 200 of an electromagnetic type (hereinafter referred to as an "electromagnetic transducer"). The conventional electromagnetic transducer 200 includes a cylindrical housing 107 and a disk-shaped yoke 106 disposed so as to cover the bottom face of the housing 107. A center pole 103, which forms an integral part of the yoke 106, is provided in a central portion of the yoke 106. A coil 104 is wound around the center pole 103. Spaced from the outer periphery of the coil 104 is provided an annular magnet 105, with an appropriate interspace maintained between the coil 104 and the inner periphery of the annular magnet 105 around the entire circumference thereof. The outer peripheral surface of the magnet 105 is abutted to the inner peripheral surface of the housing 107. An upper end of the housing 107 supports a first diaphragm 100 so that an appropriate interspace exists between the first diaphragm 100 and the magnet 105, the coil 104, and the center pole 103. In a central portion of the first diaphragm 100, a second diaphragm 101 which is made of a magnetic member is provided so as to be concentric with the first diaphragm 100.

Now, the operation and effects of the above-described conventional electromagnetic transducer 200 will be described. In an initial state where no current flows through the coil 104, a magnetic path is formed by the magnet 105, the second diaphragm 101, the center pole 103, and the yoke 106. As a result, the second diaphragm 101 is attracted toward the magnet 105 and the center pole 103, up to a point of equilibrium with the elastic force of the first diaphragm 100. If an alternating current flows through the coil 104 in this state, an alternating magnetic field is generated in the aforementioned magnetic path, so that a driving force is generated on the second diaphragm 101. Such a driving force generated on the second diaphragm 101 causes the second diaphragm 101 to be displaced from its initial state, along with the fixed first diaphragm 100, due to an interaction with an attraction force which is generated by the magnet 105 and the driving force. The vibration caused by such displacement transmits sound.

FIG. 13 illustrates a characteristic curve of the driving force generated on the second diaphragm 101 of the electromagnetic transducer 200. The vertical axis of the graph represents driving force, whereas the horizontal axis of the graph represents a distance from the center pole 103 to the second diaphragm 101 (i.e., a "magnetic gap value"). As seen from FIG. 13, once the magnetic gap value has reached a certain value (i.e., about 0.4 mm in this exemplary case), the driving force thereafter decreases in inverse proportion to the magnetic gap value. In other words, although there is a need to secure a large amplitude (and therefore a large magnetic gap value) for obtaining a high sound pressure level and enabling reproduction of low-frequency ranges, such a large magnetic gap value inevitably leads to a reduced driving force, which defeats the purpose of obtaining a high sound pressure level. On the other hand, in FIG. 13, the reduced driving force in the neighborhood of the center pole 103 is accounted for by the second diaphragm 101 experiencing magnetic saturation.

DISCLOSURE OF THE INVENTION

According to one aspect of the present invention, there is provided an electromagnetic transducer including: a first diaphragm; a second diaphragm provided in a central portion of the first diaphragm, the second diaphragm comprising a magnetic material having a first opening in a central portion thereof; a yoke disposed so as to oppose the first diaphragm; a center pole disposed between the yoke and the first diaphragm, wherein the center pole has a shape which allows insertion into the first opening; a coil disposed so as to surround the center pole; and a first magnet disposed so as to surround the coil.

In accordance with such an electromagnetic transducer, it is possible to maintain a high driving force even when a magnetic gap along the height direction is increased, by merely altering the configuration of the existing components without introducing additional components. Thus, a high sound pressure level and low-frequency range reproduction is realized.

In one embodiment of the invention, the first diaphragm has a second opening in which the center pole can be inserted.

In another embodiment of the invention, an upper face of the center pole is level with or higher than a lower face of the second diaphragm.

In accordance with such an electromagnetic transducer, a substantially constant distance can be maintained between the center pole and the second diaphragm even when the electromagnetic transducer has an amplitude of vibration. As a result, a stable driving force can be obtained.

In still another embodiment of the invention, the electromagnetic transducer further includes a first thin magnetic plate disposed between the first magnet and the first diaphragm.

In accordance with such an electromagnetic transducer, an alternating magnetic flux can be efficiently transmitted onto the second diaphragm. As a result, the driving force can be enhanced, thereby providing a high sound pressure level.

In still another embodiment of the invention, the center pole has a diameter which varies along a height direction thereof.

In still another embodiment of the invention, the diameter of the center pole varies in such a manner as to represent a quadratic curve with respect to the height of the center pole.

In accordance with such an electromagnetic transducer, variation in the magnetic resistance of the magnetic path associated with the position of the second diaphragm can be minimized.

In still another embodiment of the invention, the second diaphragm has a larger thickness at an inner periphery than at an outer periphery thereof.

In still another embodiment of the invention, the second diaphragm is turned up or down at an inner periphery thereof so as to have a substantially L-shaped cross section.

In accordance with such an electromagnetic transducer, the second diaphragm and the center pole oppose each other in an increased area, so that it is possible to increase the driving force generated on the second diaphragm.

In still another embodiment of the invention, the electromagnetic transducer further includes a cover for covering the first opening in the second diaphragm.

In still another embodiment of the invention, the cover is integral with the first diaphragm.

In accordance with such an electromagnetic transducer, it is possible to avoid a decrease in the sound pressure level due to an escape of air.

In still another embodiment of the invention, the electromagnetic transducer further includes a second magnet provided so as to be on an opposite side of the second diaphragm from the yoke.

In accordance with such an electromagnetic transducer, the use of the second magnet serves to reduce the density of the magnetic flux that is generated within the second diaphragm by the first magnet, so that more alternating magnetic flux can be transmitted into the second diaphragm. The attraction force generated within the second diaphragm can be also cancelled, whereby the first diaphragm can be placed in a state of equilibrium.

In still another embodiment of the invention, the electromagnetic transducer further includes a second thin magnetic plate provided so as to be on an opposite side of the second magnet from the yoke.

In accordance with such an electromagnetic transducer, the second magnet can be allowed to function efficiently, so that it becomes possible to reduce the size of the second magnet.

In still another embodiment of the invention, the electromagnetic transducer further includes a first housing for supporting the first diaphragm.

In still another embodiment of the invention, the electromagnetic transducer further includes a second housing for supporting the second magnet.

According to another aspect of the present invention, there is provided a portable communication device incorporating any one of the aforementioned electromagnetic transducers.

In one embodiment of the invention, the portable communication device further includes an antenna for receiving radiowaves and a transmission/reception circuit for converting the radiowaves into a voice signal, wherein the electromagnetic transducer reproduces the voice signal.

According to the present invention, a portable communication device capable of reproducing an alarm sound or melody sound, voices, and the like can be realized.

In accordance with an electromagnetic transducer of the present invention, a second diaphragm is provided which has an annular shape with an opening in a central portion thereof, whereby the mass of the entire vibrating system can be reduced. Since the annular shape of the second diaphragm prevents the second diaphragm from coming into contact with a center pole during vibration, the center pole may have an increased height. Thus, the present invention can provide an electromagnetic transducer which is capable of producing a high sound pressure level and reproducing low-frequency ranges, while allowing for a substantially smaller magnetic gap value and a stronger driving force to be generated on the second diaphragm than is conventionally possible.

Thus, the invention described herein makes possible the advantages of (1) providing an electromagnetic transducer which is capable of producing a high sound pressure level and reproducing low-frequency ranges, while allowing for a substantially smaller magnetic gap value and a stronger driving force to be generated on a second diaphragm than is conventionally possible; and (2) providing a portable communication device incorporating the same.

These and other advantages of the present invention will become apparent to those skilled in the art upon reading and understanding the following detailed description with reference to the accompanying figures.

BRIEF DESCRIPTION OF THE DRAWINGS

FIG. 13 illustrates the characteristics of a driving force generated on a second diaphragm in a conventional electromagnetic transducer.

BEST MODES FOR CARRYING OUT THE INVENTION

Hereinafter, the present invention will be described by way of illustrative examples, with reference to the accompanying figures.

EXAMPLE 1

An electromagnetic transducer 1000 according to Example 1 of the present invention will be described with reference to FIGS. 1A, 1B, 1C, 1D, and 2.

Figure 1A:
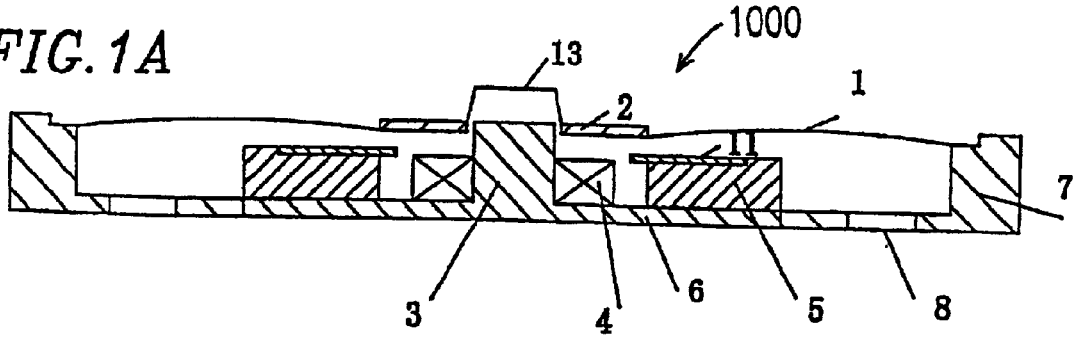
FIG. 1A is a cross-sectional view illustrating an electromagnetic transducer according to Example 1 of the present invention.
Figure 1B:
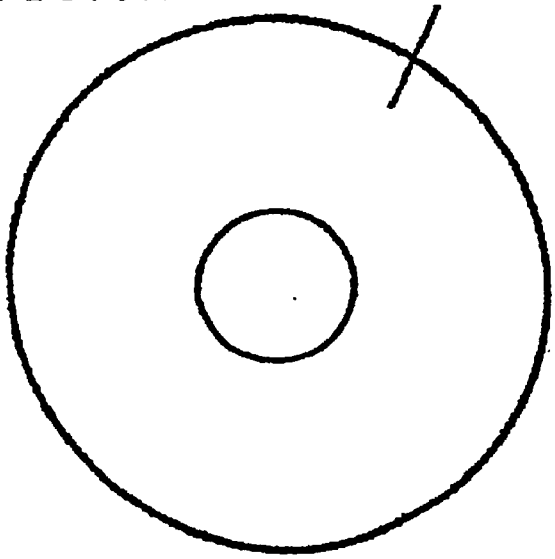
FIG. 1B is a plan view illustrating a first diaphragm in the electromagnetic transducer according to Example 1 of the present invention.
Figure 1C:
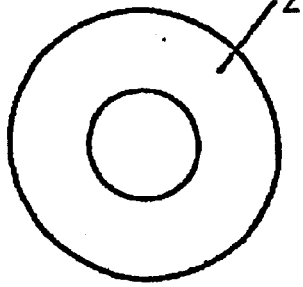
FIG. 1C is a plan view illustrating a second diaphragm in the electromagnetic transducer according to Example 1 of the present invention.
Figure 2:
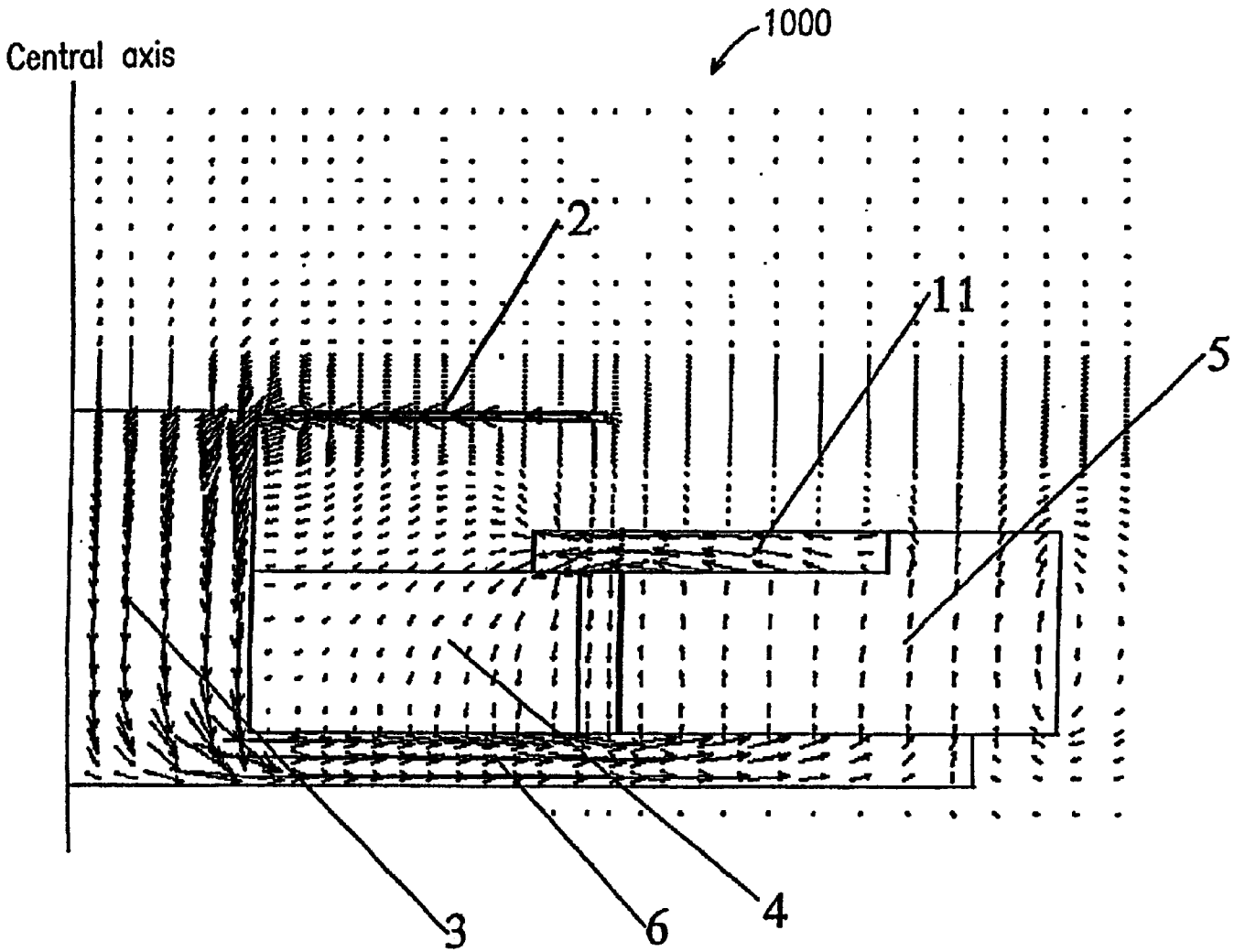
FIG. 2 is a magnetic flux vector diagram of the electromagnetic transducer according to Example 1 of the present invention.

FIG. 1A is a cross-sectional view illustrating the electromagnetic transducer 1000 according to Example 1 of the present invention. FIG. 2 is a magnetic flux vector diagram of the electromagnetic transducer 1000 according to Example 1 of the present invention. The magnetic flux vector diagram of FIG. 2 only illustrates one of the two halves of the electromagnetic transducer 1000 with respect to a central axis (shown at the left of the figure).

As shown in FIG. 1A, the electromagnetic transducer 1000 according to Example 1 of the present invention includes a cylindrical first housing 7 and a yoke 6 (having a disk shape) disposed so as to cover the bottom face of the first housing 7. A center pole 3, which may form an integral part of the yoke 6, is provided in a central portion of the yoke 6. A coil 4 is wound around the center pole 3. Spaced from the outer periphery of the coil 4 is provided an annular first magnet 5, with an appropriate interspace maintained between the coil 4 and the inner periphery of the annular first magnet 5 around the entire circumference thereof. An appropriate interspace is maintained between the outer peripheral surface of the first magnet 5 and the inner peripheral surface of the first housing 7 around the entire circumference thereof. An upper end of the first housing 7 supports a first diaphragm 1, which is composed of an annular non-magnetic member as shown in the plan view of FIG. 1B, in such a manner as to allow vibration of the first diaphragm 1. An appropriate interspace exists between the first diaphragm 1 and the coil 4, and between the first diaphragm 1 and the center pole 3. In a central portion of the first diaphragm 1, a second diaphragm 2 which is composed of an annular magnetic member is provided so as to be concentric with the first diaphragm 1. The second diaphragm 2 has an opening in a central portion as shown in the plan view of FIG. 1C. The first diaphram 1 also has an opening. In the central portion of the second diaphragm 2, a cover 13 (FIG. 1A) is provided so as to cover the opening in the second diaphragm 2. The center pole 3 is shaped so as to be capable of being inserted into the opening in the second diaphragm 2 and the opening in the first diaphram 1.

Figure 1D:
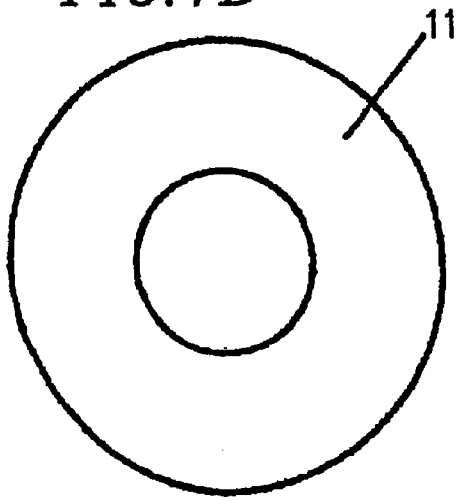
FIG. 1D is a plan view illustrating a first thin magnetic plate in the electromagnetic transducer according to Example 1 of the present invention.

A first thin magnetic plate 11, having an annular shape as shown in the plan view of FIG. 1D, is provided on a face of the first magnet 5 opposing the first diaphragm 1. On the inner peripheral surface of the first magnet 5, a concave portion for receiving the first thin magnetic plate 11 is provided. A plurality of air holes 8 are formed at predetermined intervals along the circumferential direction in the yoke 6 for allowing the space between the first diaphragm 1 and the yoke 6 to communicate with the exterior space lying outside the space between the first diaphragm 1 and the yoke 6. Each air hole 8 allows existing between the first diaphragm 1 and the yoke 6 to be released to the exterior so as to reduce the acoustic load on the first diaphragm 1.

According to the present example of the invention, PEN (polyethylene naphthalate), which is a non-magnetic material, can be used as a material of the first diaphragm 1, with a thickness of about 38 $\mu$m, for example. A permalloy is used as a material of the second diaphragm 2, with a thickness of about 50 $\mu$m, for example. The upper face of the center pole 3 is level with the upper face of the second diaphragm 2. Alternatively, the upper face of the center pole 3 may be higher than the lower face of the second diaphragm 2.

Next, the operation and effects of the electromagnetic transducer 1000 having the above-described structure will be described.

In an initial state where no current flows through the coil 4, a first magnetic path is formed by the first magnet 5, the first thin magnetic plate 11, the second diaphragm 2, the center pole 3, and the yoke 6, as shown in FIG. 2. The first diaphragm 1 is omitted from the illustration in FIG. 2 because a non-magnetic resin material is used for the first diaphragm 1 according to the present example of the invention.

In the above structure, a downward attraction force is generated on the second diaphragm 2, causing the second diaphragm 2 and the first diaphragm 1 (FIG. 1A) to be displaced.

Next, if an alternating current flows through the coil 4 in this state, an alternating magnetic field is generated, and a driving force is generated on the second diaphragm 2. Such a driving force generated on the second diaphragm 2 causes the second diaphragm 2 to be displaced from its initial state, along with the fixed first diaphragm 1. The vibration caused by such displacement transmits sound.

Figure 12A:
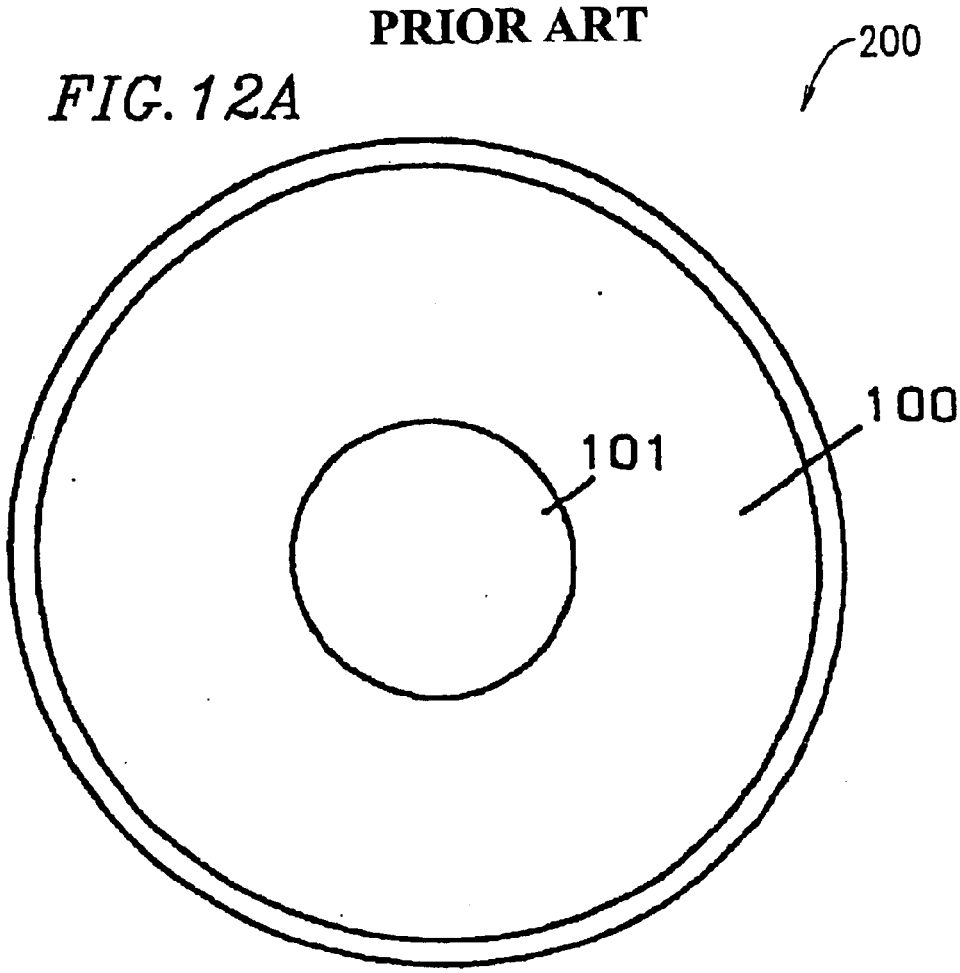
PRIOR ART FIG. 12A
FIG. 12A is a plan view illustrating a conventional electromagnetic transducer.
Figure 12B:
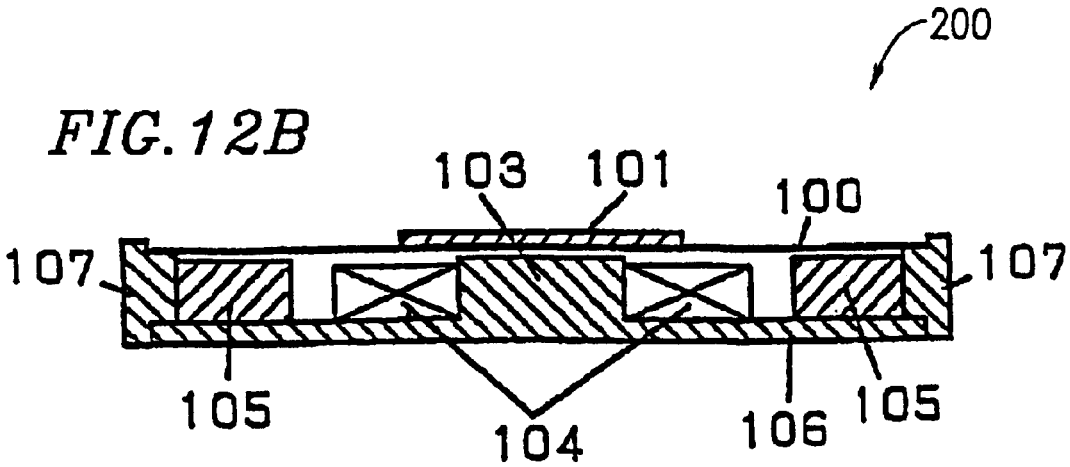
FIG. 12B is a cross-sectional view illustrating a conventional electromagnetic transducer.

In accordance with the electromagnetic transducer 1000, the center pole 3 is provided so as to penetrate through the opening in the central portion of the second diaphragm 2. In order to ensure that a peak in the driving force generated on the second diaphragm 2 substantially coincides with a zero point (i.e., the position of the second diaphragm 2 when no current flows through the coil 4), it is preferable that the upper face of the center pole 3 is level with the upper face of the second diaphragm 2. Therefore, the electromagnetic transducer 1000 shown in FIGS. 1A and 2 has a narrower magnetic gap between the second diaphragm 2 and the center pole 3 in the first magnetic path than the magnetic gap between the second diaphragm 101 and the center pole 103 in the conventional electromagnetic transducer 200 shown in FIG. 12B. As a result, the magnetic resistance in the entire first magnetic path of the electromagnetic transducer 1000 is reduced, so that the electromagnetic transducer 1000 experiences, if at all, a smaller decrease in the driving force than the conventional electromagnetic transducer 200. Therefore, even in the case where the distance between the first magnet 5 and the second diaphragm 2 is increased to obtain a large amplitude range, it is still possible to secure a sufficient driving force for obtaining a high sound pressure level. In addition, the annular configuration of the second diaphragm 2 contributes to a decrease in the mass of the vibrating system, which makes for further enhancement of the sound pressure level.

In the present example, the cover 13 covers the opening in the second diaphragm 2 so as to entirely prevent sound from being emitted through an interspace between the center pole 3 and the second diaphragm 2. However, the cover 13 can be omitted in the case where interspaces between the center pole 3 and the second diaphragm 2 and the air holes 8 are of such a relationship that substantially no sound escapes from the interspace between the center pole 3 and the second diaphragm 2. The cover 13 may be formed as an integral part of the first diaphragm 1, or as a separate member. When the cover 13 is integral with the first diaphram 1, the first diaphram 1 extends under the second diaphram 2, and thereby is connected with and integral with cover 13.

Although according to the present example of the invention a resin material is used for the first diaphragm 1 for molding facility, it is also applicable to employ a metal material (e.g., titanium) from the perspective of heat resistance. A magnetic material may be used for the first diaphragm 1. The first diaphragm 1 may be of a disk shape.

Although the first thin magnetic plate 11 is provided on the first magnet 5 according to the present example of the invention, the first thin magnetic plate 11 may be omitted in the case where sufficient driving force can be obtained with the first magnet 5 alone, or under stringent spatial constraints.

Figure 3:
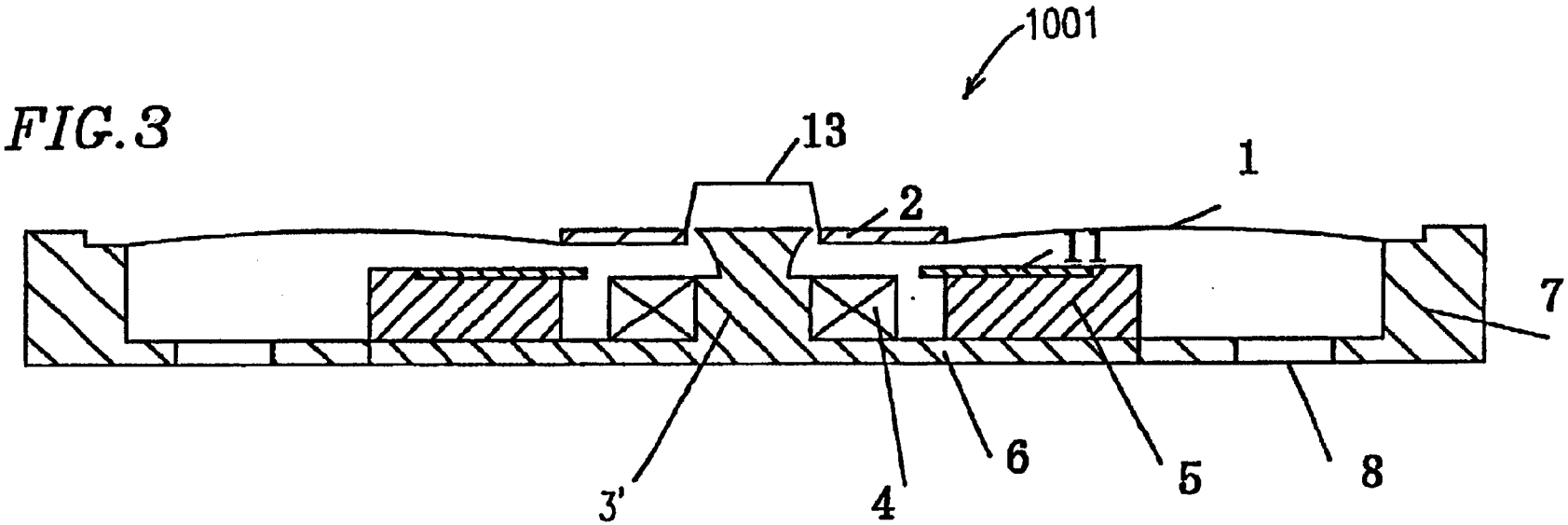
FIG. 3 is a cross-sectional view illustrating the electromagnetic transducer according to Example 1 of the present invention.

Although the center pole 3 is illustrated as having a constant diameter according to the present example of the invention, the center pole 3 may have a varying diameter along its height direction. As an example, a cross-sectional view is given in FIG. 3 showing an electromagnetic transducer 1001 including a center pole 3' whose diameter decreases toward the yoke 6. Other than the center pole 3', the electromagnetic transducer 1001 has the same component elements as those of the electromagnetic transducer 1000 (shown in FIG. 1A).

In accordance with the electromagnetic transducer 1001, the magnetic gap between the second diaphragm 2 and the center pole 3' increases as the second diaphragm 2 is displaced in a downward direction, whereby the decrease in the driving force due to magnetic saturation (illustrated with reference to FIG. 13) can be reduced. The diameter of the center pole 3' may vary along its height direction in such a manner as to represent a quadratic curve with respect to the height, as shown in FIG. 3.

EXAMPLE 2

An electromagnetic transducer 2000 according to Example 2 of the present invention will be described with reference to FIGS. 4A, 4B, and 5.

Figure 4A:
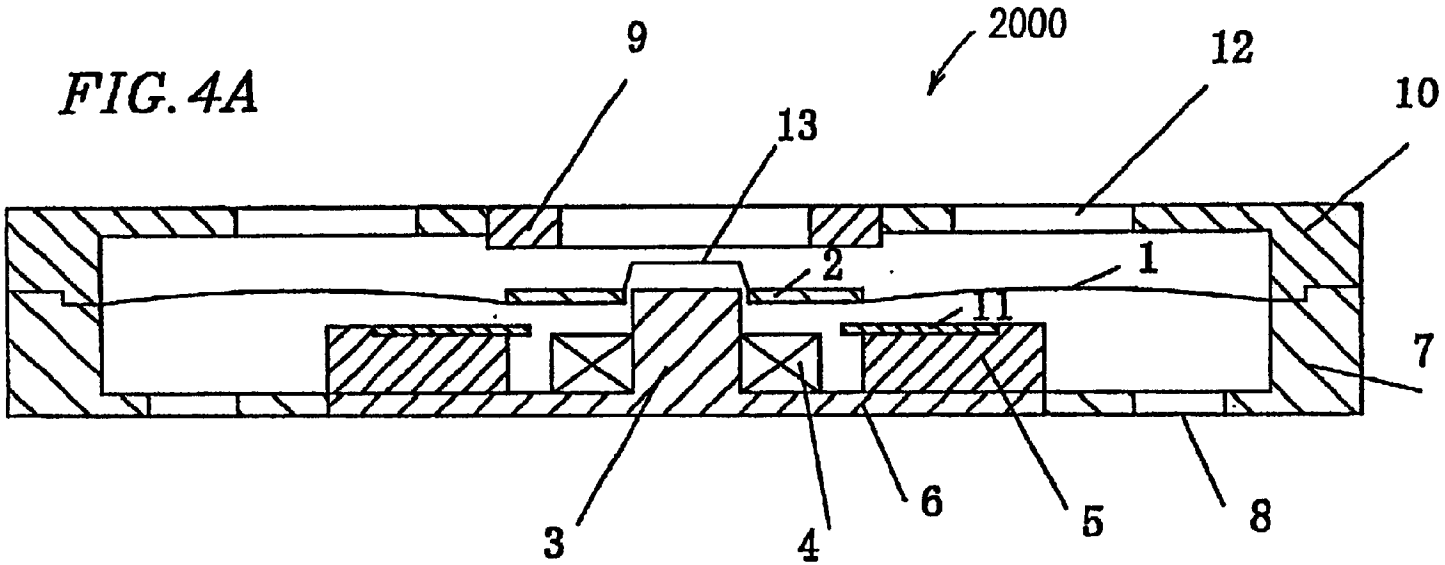
FIG. 4A is a cross-sectional view illustrating an electromagnetic transducer according to Example 2 of the present invention.
Figure 5:
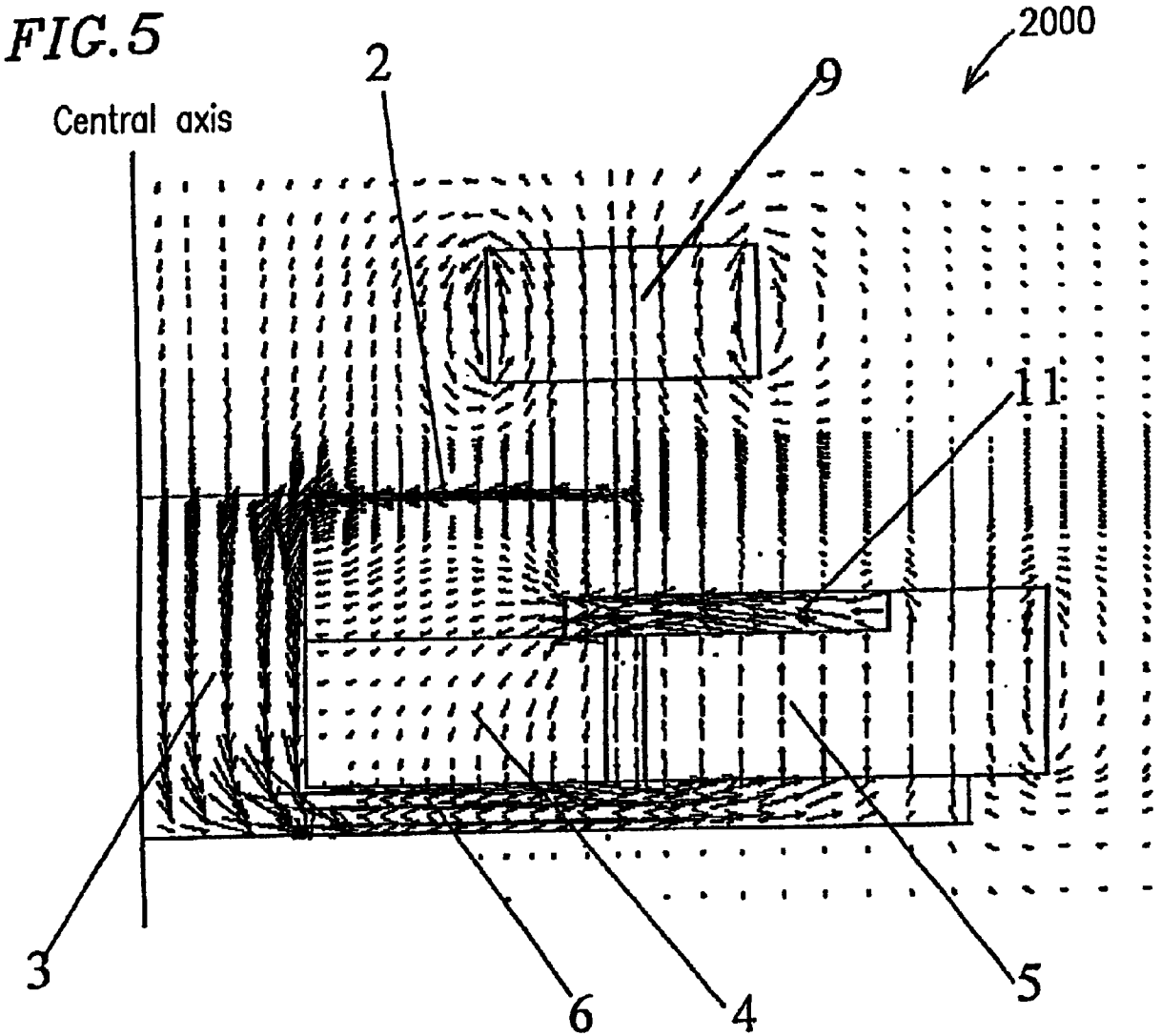
FIG. 5 is a magnetic flux vector diagram of the electromagnetic transducer according to Example 2 of the present invention.

FIGS. 4A and 5 are a cross-sectional view and a magnetic flux vector diagram, respectively, illustrating the electromagnetic transducer 2000 according to Example 2 of the present invention. The magnetic flux vector diagram of FIG. 5 only illustrates one of the two halves of the electromagnetic transducer 2000 with respect to a central axis (shown at the left of the figure).

Figure 4B:
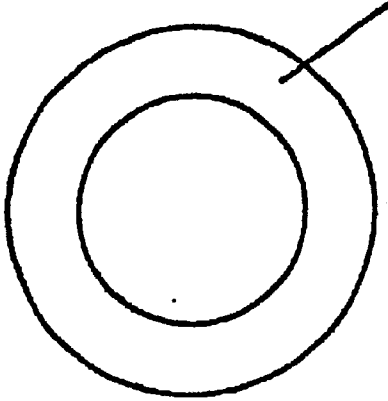
FIG. 4B is a plan view illustrating a second magnet in the electromagnetic transducer according to Example 2 of the present invention.

In accordance with the electromagnetic transducer 2000 shown in FIG. 4A, a second magnet 9, having an annular shape as shown in the plan view of FIG. 4B, is provided above the second diaphragm 2 with a magnetic gap therebetween. The second magnet 9 is supported by a second housing 10. Holes 12 for allowing sound generated by the first and second diaphragms 1 and 2 and the cover 13 to be emitted to the exterior space lying outside the second housing 10 are provided in the second housing 10. The second magnet 9 is magnetized along its height direction, as is the first magnet 5. Otherwise, the electromagnetic transducer 2000 has the same structure as that of the electromagnetic transducer 1000 shown in FIG. 1.

Next, the operation and effects of the electromagnetic transducer 2000 having the above-described structure will be described.

As in the case of Example 1 (FIG. 2), a first magnetic path is formed by the first magnet 5, the first thin magnetic plate 11, the second diaphragm 2, the center pole 3, and the yoke 6, as shown in FIG. 5. In addition, a second magnetic path is formed by the second magnet 9 and the second diaphragm 2, according to the present example of the invention.

In an initial state where no current flows through the coil 4, a downward attraction force generated through the first magnetic path and an upward attraction force generated through the second magnetic path are at equilibrium on the second diaphragm 2. Therefore, the first diaphragm 1 undergoes substantially no displacement due to the first magnetic path.

Next, if an alternating current flows through the coil 4 in this state, an alternating magnetic field is generated, and a driving force is generated on the second diaphragm 2. Such a driving force generated on the second diaphragm 2 causes the second diaphragm 2 to be displaced from its initial state, along with the fixed first diaphragm 1. The vibration caused by such displacement transmits sound.

Figure 6:
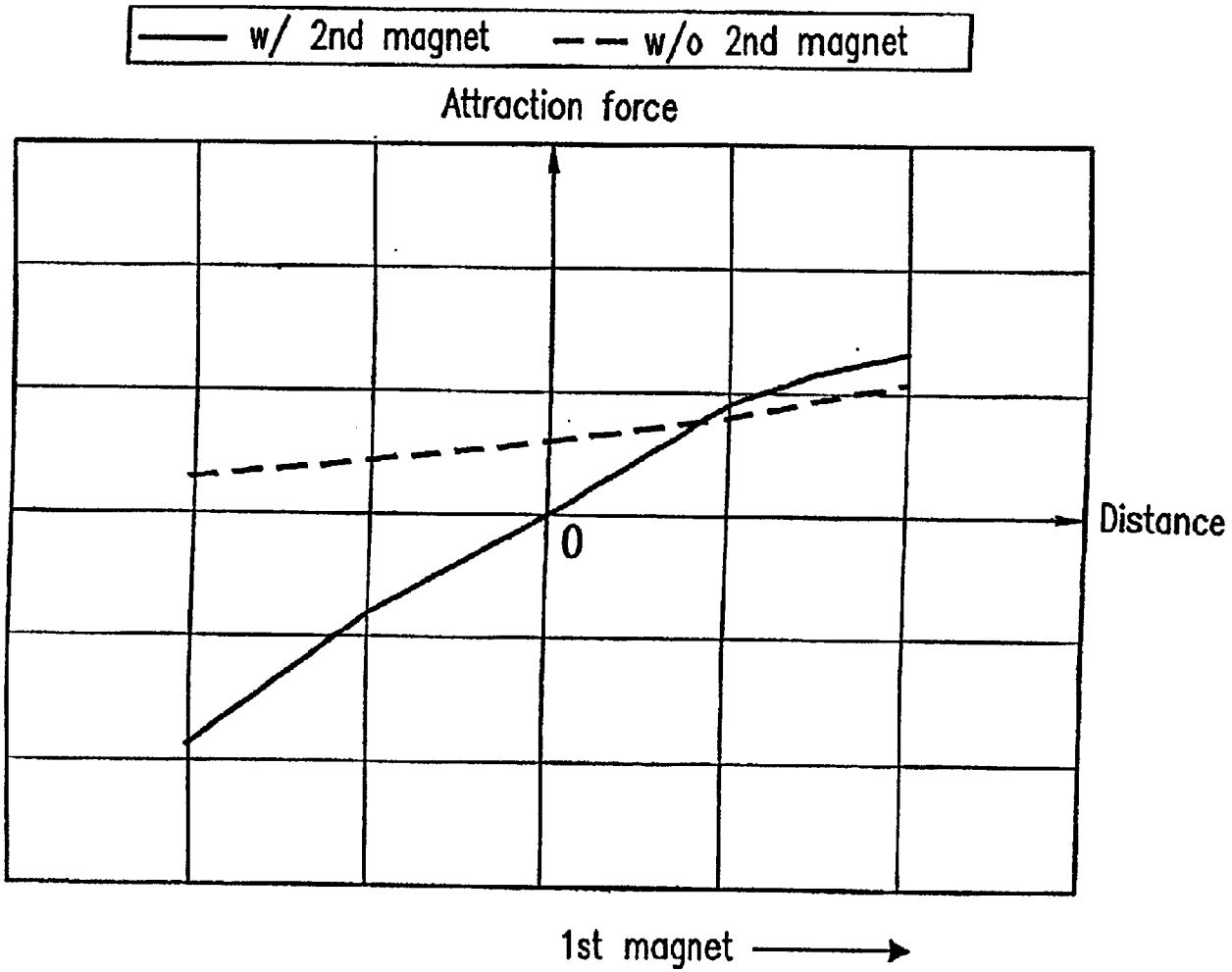
FIG. 6 is a graph illustrating the characteristics of an attraction force generated on a second diaphragm in the electromagnetic transducer according to Example 2 of the present invention.

FIG. 6 is a graph illustrating the attraction force generated on the second diaphragm 2, with respect to the case where the second magnet 9 is provided and the case where the second magnet 9 is not provided. The vertical axis represents attraction force, whereas the horizontal axis represents a distance from a zero point to the second diaphragm 2. As used herein, the "zero point" refers to a position taken by the second diaphragm 2 when the downward and upward attraction forces applied by the first and second magnets 5 and 9, respectively, on the second diaphragm 2 are at equilibrium. The solid line in the graph represents the case where the second magnet 9 is provided; and the broken line in the graph represents the case where the second magnet 9 is not provided.

As shown in FIG. 6, in the case where the second magnet 9 is not provided, the attraction force always has a positive value because the second diaphragm 2 is attracted to the first magnet 5.

On the other hand, in the case where the second magnet 9 is provided, an additional attraction force is generated in the opposite direction from the first magnet 5. As a result, the attraction force can properly take either positive or negative values, with respect to the zero point at which the upward and downward attraction forces are at equilibrium on the second diaphragm 2.

According to the present example, the thickness of the second diaphragm 2 is as thin as about 50 $\mu$m, so as to facilitate magnetic saturation. As a result, the drastic increase in the attraction force which would otherwise occur as the second diaphragm 2 approaches the first magnet 5 is subdued. Due to such configuration, the attraction force presents a substantially linear characteristic curve with respect to the distance from the zero point, as shown in FIG. 6.

As a result, it is possible to reduce the stiffness of the entire system, which can be calculated as a difference between the elastic force of the first diaphragm 1 and the attraction force. Accordingly, the resonance frequency of the system, which is determined by the stiffness, can be lowered.

If the elastic force characteristics of the first diaphragm 1 are similar to the attraction force characteristics (i.e., if the first diaphragm 1 has linear elastic force characteristics), the entire system has a constant stiffness independent of the position of the second diaphragm 2. As a result, fluctuation in the resonance frequency due to different voltages levels being applied is prevented, and harmonic distortion is minimized.

Figure 7:
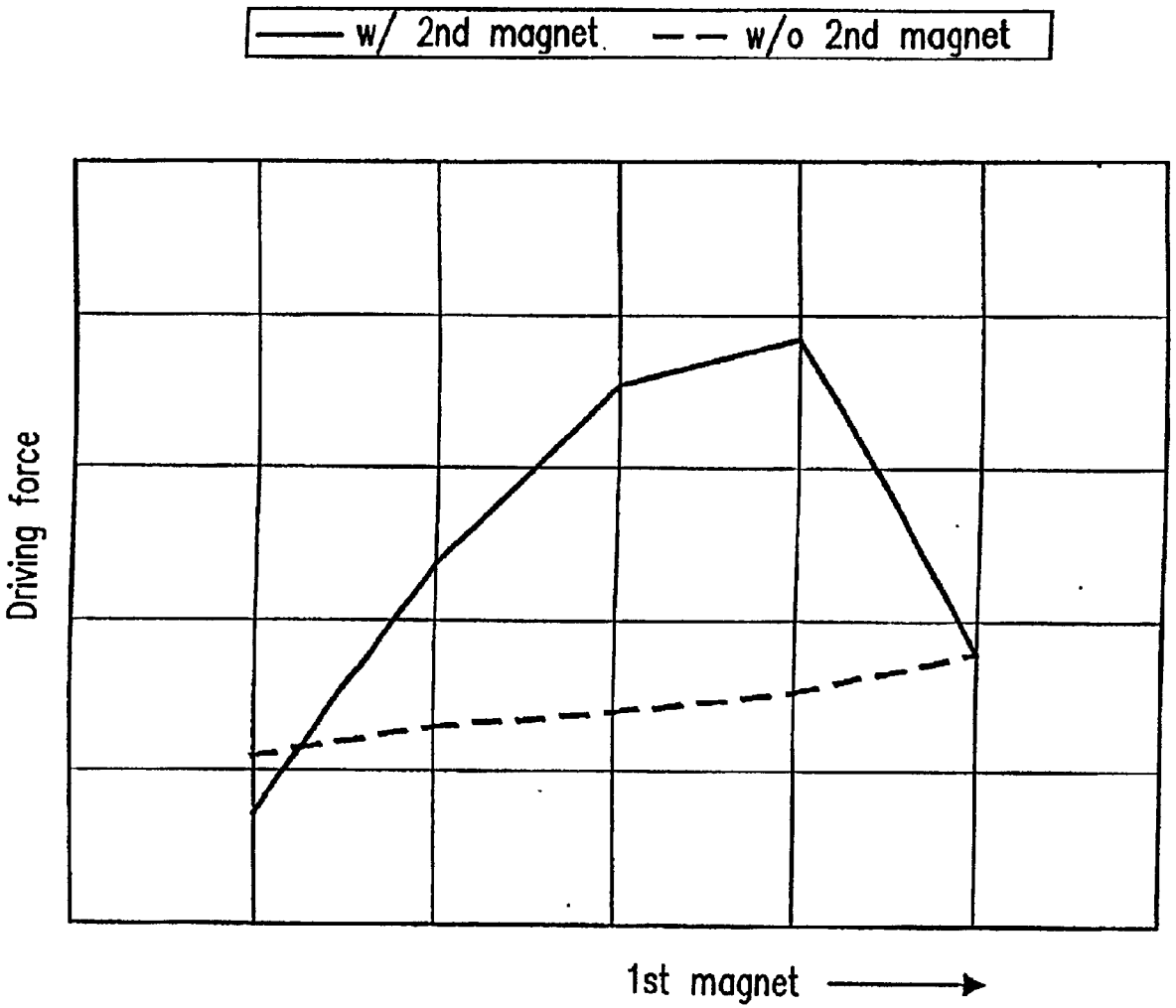
FIG. 7 is a graph illustrating the characteristics of a driving force generated on a second diaphragm in the electromagnetic transducer according to Example 2 of the present invention.

FIG. 7 is a graph illustrating the driving force generated on the second diaphragm 2, with respect to the case where the second magnet 9 is provided and the case where the second magnet 9 is not provided. The vertical axis represents driving force, whereas the horizontal axis represents a distance of the second diaphragm 2 from the first magnet 5. As in FIG. 6, the solid line in the graph represents the case where the second magnet 9 is provided; and the broken line in the graph represents the case where the second magnet 9 is not provided.

In FIG. 7, in the case where the second magnet 9 is not provided, magnetic saturation occurs due to the use of the relatively thin second diaphragm 2, so that a sufficient driving force cannot be obtained.

Therefore, by the addition of the second magnet 9, the magnetic flux generated by the first magnet 5 and acting on the second diaphragm 2 can be canceled, so that magnetic saturation is alleviated. Consequently, an alternating magnetic flux, which provides the driving force, can efficiently flow into the second diaphragm 2, resulting in a large driving force. Thus, a sufficient driving force can be obtained despite the use of the relatively thin second diaphragm 2, which would otherwise be susceptible to magnetic saturation. The reduced thickness of the second diaphragm 2 also contributes to a decrease in the mass of the vibrating system, which makes for further enhancement of the sound pressure level.

Although the thickness of the second diaphragm 2 according to the present example of the invention is as thin as about 50 $\mu$m in order to facilitate magnetic saturation, it is also applicable to employ a relatively thick second diaphragm 2 without considering magnetic saturation. In such a case, decrease in the driving force in the neighborhood of the first magnet 5 due to magnetic saturation (illustrated in FIG. 7) will not occur; therefore, the use of a relatively thick second diaphragm 2 is effective in embodiments of the invention where the second diaphragm 2 is used in the neighborhood of the first magnet 5. Similar effects can be obtained by using a material having a relatively large saturation magnetization level, e.g., pure iron, as the material for the second diaphragm 2.

Although the second housing 10 is provided for supporting the second magnet 9 according to the present example of the invention, in applications where the electromagnetic transducer 2000 is incorporated in a cellular phone, for example, the second magnet 9 may be embedded within the housing of the cellular phone. Thus, the same housing can be shared by the electromagnetic transducer 2000 and the cellular phone.

EXAMPLE 3

An electromagnetic transducer 3000 according to Example 3 of the present invention will be described with reference to FIGS. 8A, 8B, and 9.

Figure 8A:
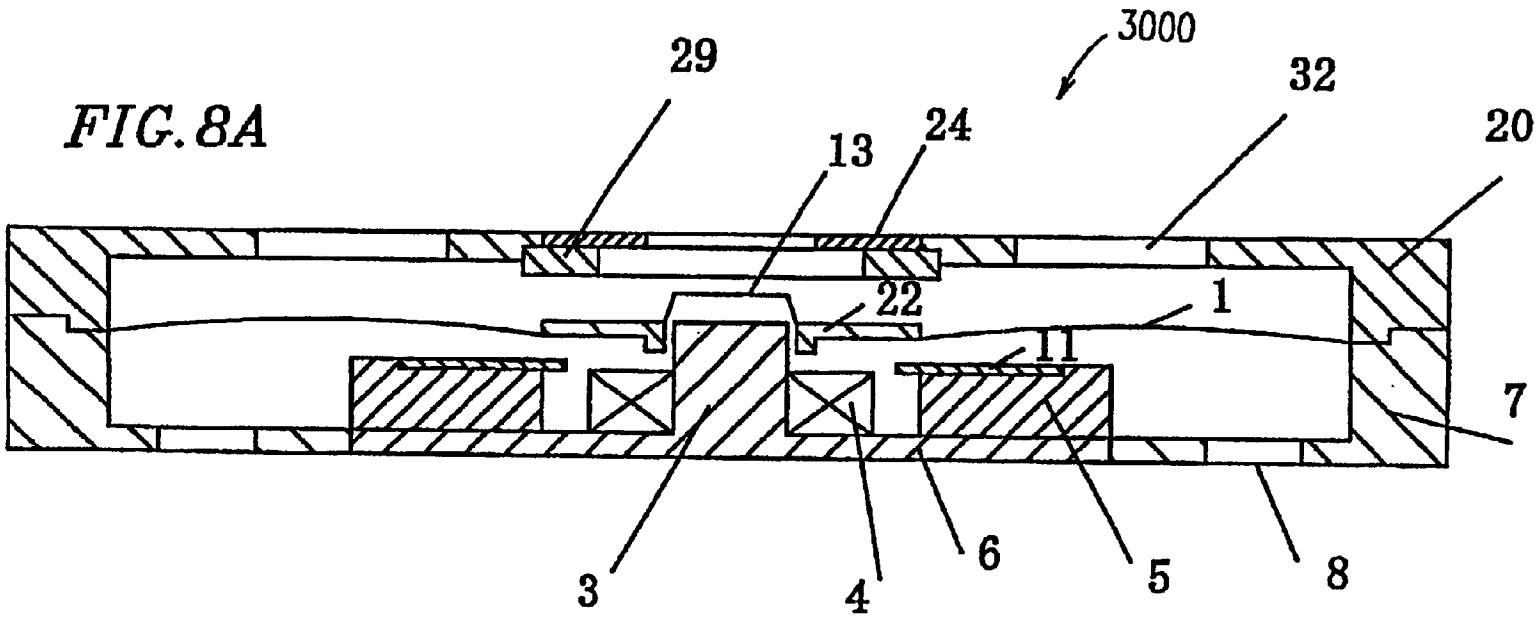
FIG. 8A is a cross-sectional view illustrating an electromagnetic transducer according to Example 3 of the present invention.
Figure 9:
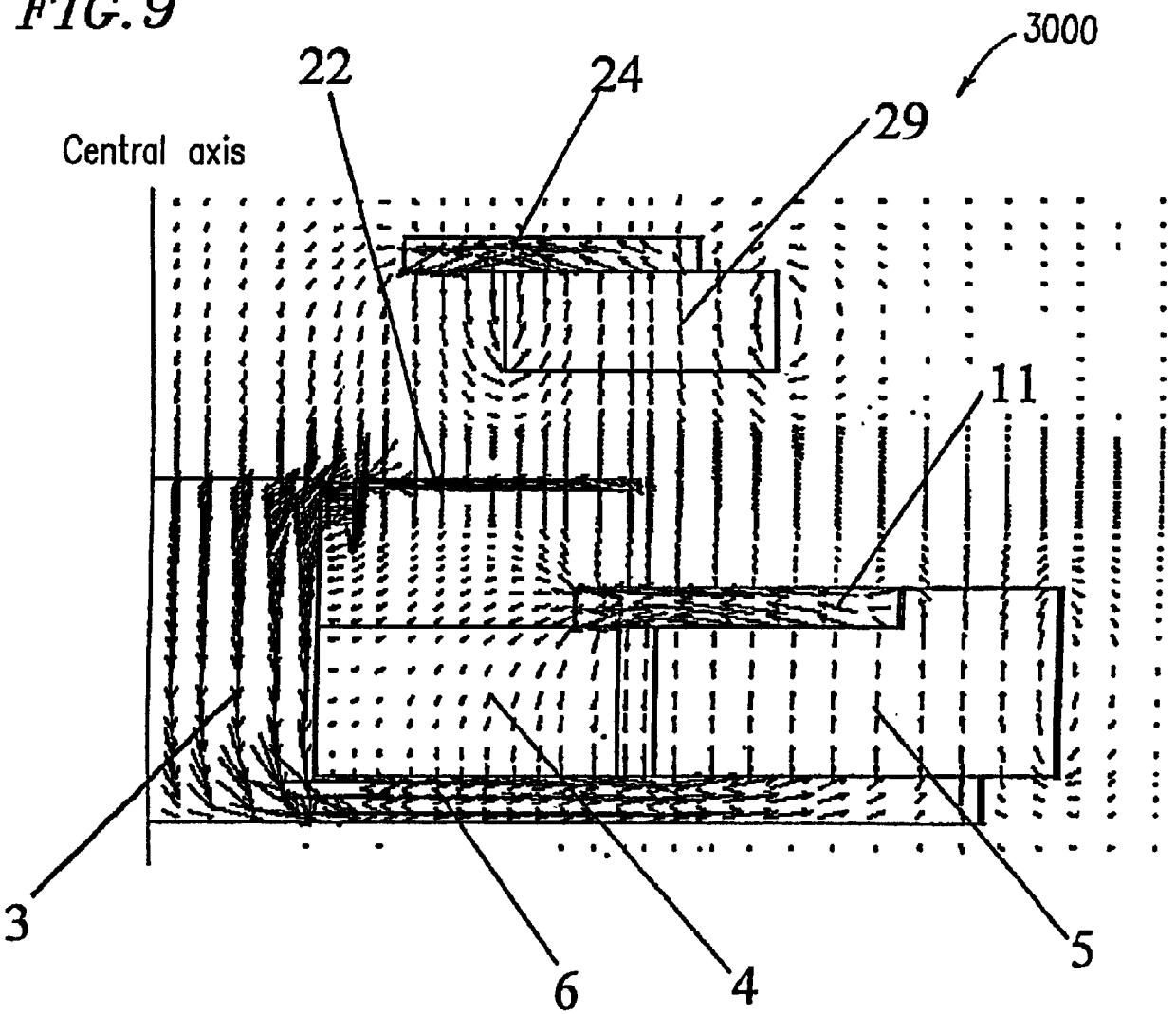
FIG. 9 is a magnetic flux vector diagram of the electromagnetic transducer according to Example 3 of the present invention.

FIGS. 8A and 9 are a cross-sectional view and a magnetic flux vector diagram, respectively, illustrating the electromagnetic transducer 3000 according to Example 3 of the present invention. The magnetic flux vector diagram of FIG. 9 only illustrates one of the two halves of the electromagnetic transducer 3000 with respect to a central axis (shown at the left of the figure).

Figure 8B:
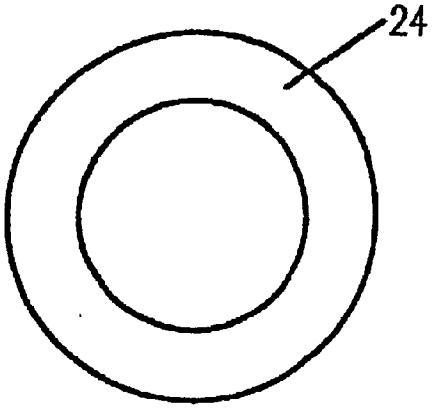
FIG. 8B is a plan view illustrating a second thin magnetic plate in the electromagnetic transducer according to Example 3 of the present invention.

The electromagnetic transducer 3000 shown in FIG. 8A includes a second diaphragm 22 having an L-shaped cross section at its inner periphery, an annular second magnet 29 which is provided above the second diaphragm 22 with a magnetic gap therebetween, and a second thin magnetic plate 24, having an annular shape as shown in the plan view of FIG. 8B.

The second magnet 29 is supported by a second housing 20. The second housing 20 has a concave portion for receiving the second thin magnetic plate 24. Holes 32 for allowing sound generated by the first and second diaphragms 1 and 22 to be emitted to the exterior space lying outside the second housing 20 are provided in the second housing 20. Otherwise, the electromagnetic transducer 3000 has the same structure as that of the electromagnetic transducer 2000 according to Example 2 of the present invention shown in FIG. 4A.

Since the second thin magnetic plate 24 is provided on the upper face of the second magnet 29, a second magnetic path is formed by the second magnet 29, the second thin magnetic plate 24, and the second diaphragm 22, as shown in FIG. 9. The first magnet 5 and the second magnet 29 provide the same effects as those of the first magnet 5 and the second magnet 9 (FIG. 4A) according to Example 2 of the present invention. The energy product of the second magnet 29 is adjusted so that the magnetic flux from the second magnet 29 will be transmitted to the second thin magnetic plate 24 to form an appropriate magnetic path.

Since the second diaphragm 22 has an L-shaped cross section at its inner periphery as shown in FIG. 8A, the magnetic flux concentrates at the inner periphery of the second diaphragm 22, so that magnetic flux can be efficiently transmitted between the second diaphragm 22 and the center pole 3. The second diaphragm 22 may have any cross-sectional shape which presents a larger thickness at the inner periphery than at the outer periphery, e.g., a triangular or trapezoidal cross section. Two or more diaphragms having different outer diameters may be stacked to form the second diaphragm 22. Since the second diaphragm 22 and the center pole 3 oppose each other in an increased area due to the increased thickness of the second diaphragm 22 at its inner periphery, it is possible to increase the air resistance between the second diaphragm 22 and the center pole 3. In such a case, the cover 13 can be omitted from the electromagnetic transducer 3000.

The second thin magnetic plate 24 provided as shown in FIG. 8A allows the magnetic flux from the second magnet 29 to be transmitted via the second thin magnetic plate 24, so that the second magnetic path attains a reduced magnetic resistance. As a result, the energy product of the second magnet 29 can be reduced as compared to the case where the second thin magnetic plate 24 is not provided. Furthermore, since the magnetic flux from the second magnet 29 is transmitted into the second thin magnetic plate 24, the amount of magnetic flux leaking to the outside of the electromagnetic transducer 3000 can be reduced.

In accordance with the electromagnetic transducer 3000 of the present example, the same attraction force that is provided by a structure which lacks the second thin magnetic plate 24 (e.g., the electromagnetic transducer 2000 shown in FIG. 4A) under the conditions that the second magnet 9 has an energy product of about 26 MGOe and a thickness of about 0.7 mm can be achieved under the conditions that the second magnet 29 has an energy product of about 22 MGOe and a thickness of about 0.5 mm, due to the addition of the second thin magnetic plate 24.

The first diaphragm 1 in each of the electromagnetic transducers 1000, 1001, 2000, and 3000 described in Examples 1 to 3 of the present invention is configured such that a portion of its annular shape is raised in a direction perpendicular to the direction of its diameter. However, the first diaphragm 1 is not limited to such a shape, but may instead have a flat cross section.

EXAMPLE 4

Figure 10:
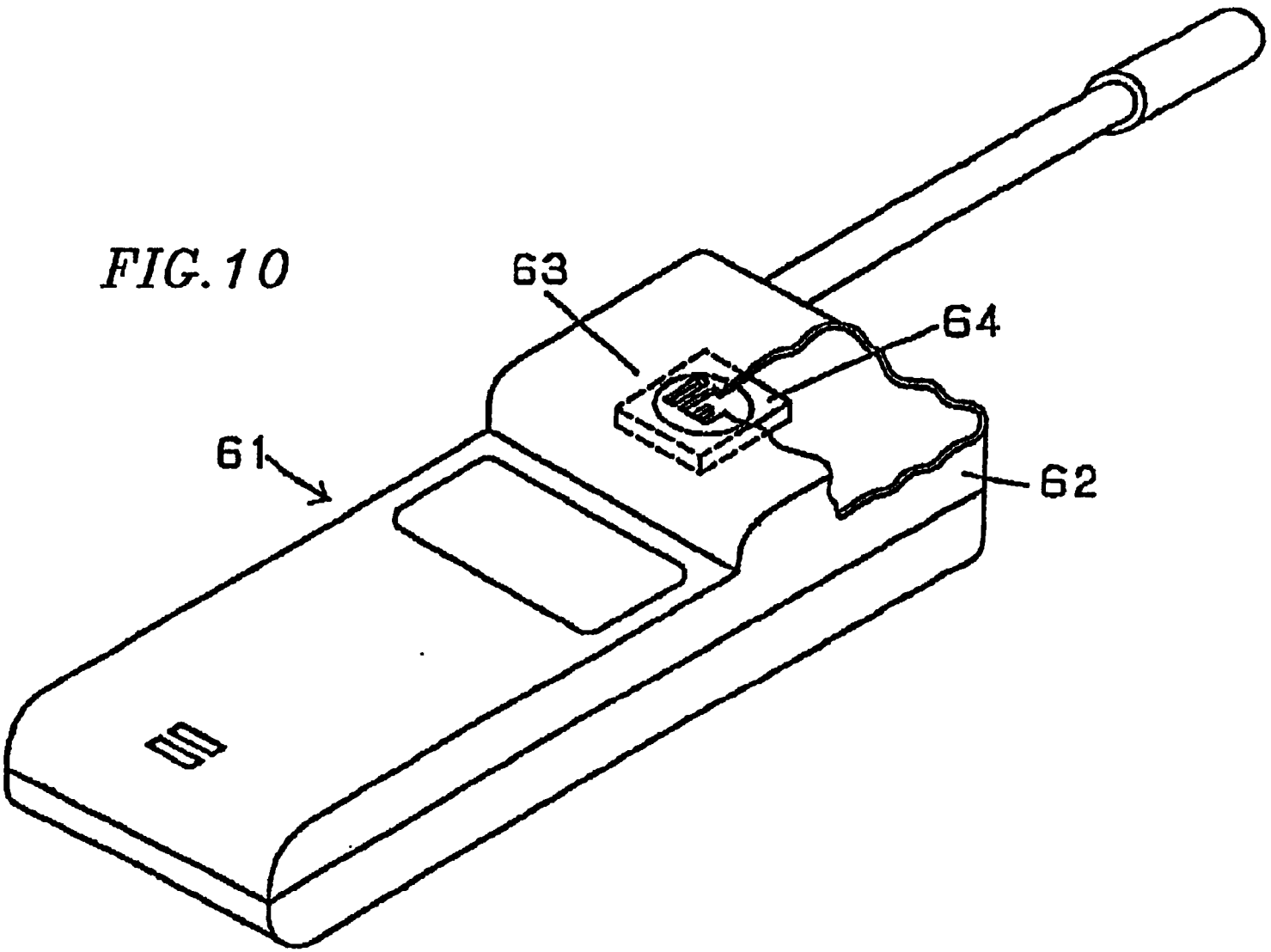
FIG. 10 is a partially-cutaway perspective view of a cellular phone incorporating an electromagnetic transducer according to Example 4 of the present invention.
Figure 11:
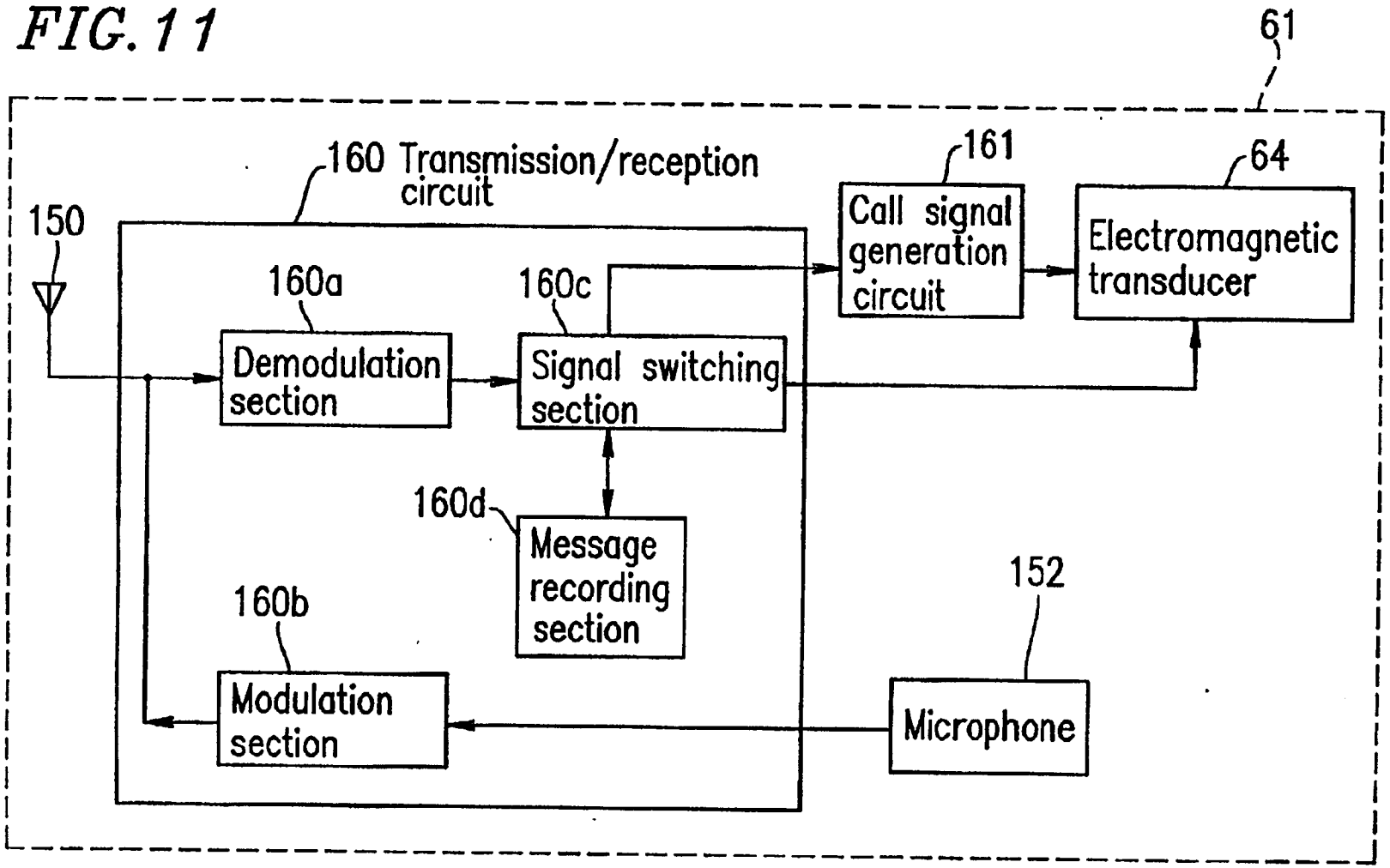
FIG. 11 is a block diagram illustrating the structure of the cellular phone incorporating an electromagnetic transducer according to Example 4 of the present invention.

As Example 4 of the present invention, a cellular phone 61 will be described with reference to FIGS. 10 and 11, as one implementation of a portable communication device incorporating the electromagnetic transducer according to the present invention. FIG. 10 is a partially-cutaway perspective view of the cellular phone 61 according to Example 4 of the present invention. FIG. 11 is a block diagram schematically illustrating the structure of the cellular phone 61.

The cellular phone 61 includes a housing 62, which has a soundhole 63, and an electromagnetic transducer 64. As the electromagnetic transducer 64 to be incorporated in the cellular phone 61, any one of the electromagnetic transducers 1000, 1001, 2000, and 3000 illustrated in Examples 1 to 3 can be employed. The electromagnetic transducer 64 is disposed in such an orientation that its diaphragm opposes the sound hole 63.

As shown in FIG. 11, the cellular phone 61 further includes an antenna 150, a transmission/reception circuit 160, a call signal generation circuit 161, and a microphone 152. The transmission/reception circuit 160 includes a demodulation section 160*a*, a modulation section 160*b*, a signal switching section 160*c*, and a message recording section 160*d*.

The antenna 150 is used in order to receive radiowaves which are output from a nearby base station and to transmit radiowaves to the base station. The demodulation section 160*a* demodulates and converts a modulated signal which has been input via the antenna 150 into a reception signal, and outputs the reception signal to the signal switching section 160*c*. The signal switching section 160*c* is a circuit which switches between different signal processes depending on the contents of the reception signal. If the reception signal is a signal indicative of a received call (hereinafter referred to as a "call received" signal), the reception signal is output to the electromagnetic transducer 64. If the reception signal is a voice signal for message recording, the reception signal is output to the message recording section 160*d*. The message recording section 160*d* is composed of a semiconductor memory (not shown), for example. Any recorded message which is left while the cellular phone 61 is ON is stored in the message recording section 160*d*. Any recorded message which is left while the cellular phone 61 is out of serviced areas or while the cellular phone 61 is OFF is stored in a memory device within the base station. The call signal generation circuit 161 generates a call signal, which is output to the electromagnetic transducer 64.

As is the case with conventional cellular phones, the cellular phone 61 includes a small microphone 152 as an electromagnetic transducer. The modulation section 160*b* modulates a dial signal and/or a voice signal which has been transduced by the microphone 152 and outputs the modulated signal to the antenna 150.

Now, the operation of the cellular phone 61 as a portable communication device having the above structure will be described.

The radiowaves which are output from the base station are received by the antenna 150, and are demodulated by the demodulation section 160*a* into a base-band reception signal. Upon determination that the reception signal is a call received signal, the signal switching circuit 160*c* outputs the signal indicative of a received call to the call signal generation circuit 161 in order to inform the user of the cellular phone 61 of the received call.

Upon receiving a call received signal, the call signal generation circuit 161 outputs a call signal. The call signal includes a signal corresponding to a pure tone in the audible range or a complex sound composed of such pure tones. When the signal is inputted to the electromagnetic transducer 64, the electromagnetic transducer 64 outputs a ringing tone to the user.

Once the user enters a talk mode, the signal switching circuit 160*c* performs a level adjustment of the reception signal, and thereafter outputs the received voice signal directly to the electromagnetic transducer 64. The electromagnetic transducer 64 operates as a receiver or a loudspeaker to reproduce the voice signal.

The voice of the user is detected by the microphone 152 and converted into a voice signal, which is inputted to the modulation section 160*b*. The voice signal is modulated by the modulation section 160*b* onto a predetermined carrier wave, which is output via the antenna 150.

If the user has set the cellular phone 61 in a message recording mode and leaves the cellular phone 61 ON, any recorded message that is left by a caller will be stored in the message recording section 160*d*. If the user has turned the cellular phone 61 OFF, any recorded message that is left by a caller will be temporarily stored in the base station. As the user requests reproduction of the recorded message via a key operation, the signal switching circuit 160*c* receives such a request, and retrieves the recorded message from the message recording section 160*d* or from the base station. The voice signal is adjusted to an amplified level and output to the electromagnetic transducer 64. Then, the electromagnetic transducer 64 operates as a receiver or a loudspeaker to reproduce the recorded message.

Many electromagnetic transducers incorporated in portable communication devices, such as conventional cellular phones, have a high resonance frequency, and are therefore only used for reproducing a ringing tone.

However, the electromagnetic transducer according to the present invention can have a low resonance frequency. When incorporated in a portable communication device, the electromagnetic transducer according to the present invention can also be used for reproducing a voice signal, so that both a ringing tone and a voice signal can be reproduced by the same electromagnetic transducer. Thus, the number of acoustic elements to be incorporated in the portable communication device can be effectively reduced.

In the illustrated cellular phone 61, the electromagnetic transducer 64 is mounted directly on the housing 62. However, the electromagnetic transducer 64 may be mounted on a circuit board which is internalized in the cellular phone 61. An acoustic port for increasing the sound pressure level of the ringing tone may be additionally included.

Although a cellular phone is illustrated in FIGS. 10 and 11 as a portable communication device, the present invention is applicable to any portable communication device that incorporates an electromagnetic transducer, such as a pager, a notebook-type personal computer, or a watch.

The second housing 10 or 20 for supporting the second magnet 9 or 29 is employed in Example 2 or 3 of the present invention. However, when the electromagnetic transducer 2000 or 3000 according to Example 2 or 3 of the present invention is to be mounted in the cellular phone 61 shown in FIG. 10, for example, the second magnet 9 or 29 may be embedded in the housing 62 of the cellular phone 61, so that the housing 62 of the cellular phone 61 acts as the second housing 10 or 20. Moreover, the second thin magnetic plate 24 of the electromagnetic transducer 3000 may similarly be provided on the housing 62 of the cellular phone 61.

INDUSTRIAL APPLICABILITY

In accordance with an electromagnetic transducer of the present invention, an opening is formed in a central portion of a second diaphragm, and a center pole is provided so as to penetrate through the opening, so that a distance that forms a magnetic path between the second diaphragm and the center pole can be reduced as compared to those in conventional electromagnetic transducers. As a result, a sufficient driving force for causing a first diaphragm to have a large amplitude can be obtained, thereby enabling reproduction with a high sound pressure level.

In accordance with an electromagnetic transducer of the present invention, a first thin magnetic plate on a face of a first magnet opposing the first diaphragm, thereby allowing an alternating magnetic flux to efficiently flow into the second diaphragm. As a result, a large driving force is provided, thereby making for a high sound pressure level.

In accordance with an electromagnetic transducer of the present invention, a second magnet is provided above the second diaphragm with a magnetic gap therebetween, thereby allowing the first diaphragm to be maintained in a state of equilibrium. As a result, a large driving force acting on the second diaphragm is provided. Since a substantially linear relationship exists between the attraction force and the displacement characteristics of the first diaphragm, it is possible to realize reproduction with a high sound pressure level and low distortion. By further providing a second thin magnetic plate above the second magnet, the second magnet can be allowed to efficiently function can be downsized in shape.

In accordance with a portable communication device incorporating an electromagnetic transducer of the present invention, it is possible to reproduce an alarm sound or melody sound as well as voices and the like with the portable communication device.

What is claimed is:

1. An electromagnetic transducer comprising:

a first diaphragm;

a second diaphragm provided in a central portion of the first diaphragm, the second diaphragm comprising a magnetic material having an opening in a central portion thereof;

a yoke disposed so as to oppose the first diaphragm;

a center pole disposed between the yoke and the first diaphragm, wherein the center pole has a shape which allows insertion into the opening;

a coil disposed so as to surround the center pole; and a first magnet disposed so as to surround the coil.

2. An electromagnetic transducer according to claim 1, wherein the first diaphragm has an opening in which the center pole can be inserted.

3. An electromagnetic transducer according to claim 1, wherein an upper face of the center pole is level with a lower face of the second diaphragm.

4. An electromagnetic transducer according to claim 1, further comprising a first thin magnetic plate disposed between the first magnet and the first diaphragm.

5. An electromagnetic transducer according to claim 1, wherein the second diaphragm has a larger thickness at an inner periphery than at an outer periphery thereof.

6. An electromagnetic transducer according to claim 1, wherein the second diaphragm is turned up or down at an inner periphery thereof so as to have a substantially L-shaped cross section.

7. An electromagnetic transducer according to claim 1, further comprising a first housing for supporting the first diaphragm.

8. An electromagnetic transducer according to claim 1, wherein an upper face of the center pole is higher than a lower face of the second diaphragm.

9. An electromagnetic transducer according to claim 1, wherein the center pole has a diameter which varies along a height direction thereof.

10. An electromagnetic transducer according to claim 9, wherein the diameter of the center pole varies in such a manner as to represent a quadratic curve with respect to the height of the center pole.

11. An electromagnetic transducer according to claim 1, further comprising a cover for covering the opening in the second diaphragm.

12. An electromagnetic transducer according to claim 11, wherein the cover is integral with the first diaphragm.

13. An electromagnetic transducer according to claim 1, further comprising a second magnet provided so as to be on an opposite side of the second diaphragm from the yoke.

14. An electromagnetic transducer according to claim 13, further comprising a second thin magnetic plate provided so as to be an opposite side of the second magnet from the yoke.

15. An electromagnetic transducer according to claim 13, further comprising a second housing for supporting the second magnet.

16. A portable communication device comprising an electromagnetic transducer comprising:

a first diaphragm;

a second diaphram provided in a central portion of the first diaphragm, the second diaphragm comprising a magnetic material having an opening in a central portion thereof;

a yoke disposed so as to oppose the first diaphram;

a center pole disposed between the yoke and the first diaphram, wherein the center pole has a shape which allows insertion into the opening;

a coil disposed so as to surround the center pole; and a first magnet disposed so as to surround the coil.

17. A portable communication device according to claim 15, further comprising an antenna for receiving radiowaves and a transmission/reception circuit for converting the radiowaves into a voice signal, wherein the electromagnetic transducer reproduces the voice signal.

18. A portable communication device according to claim 16, wherein an upper face of the center pole is higher than a lower face of the second diaphragm.

19. A portable communication device according to claim 16, wherein the first diaphram has an opening in which the center pole can be inserted.

20. A portable communication device according to claim 19, further comprising an antenna for receiving radiowaves and a transmission/reception circuit for converting the radiowaves into a voice signal, wherein the electromagnetic transducer reproduces the voice signal.

21. A portable communication device according to claim 16, wherein an upper face of the center pole is level with a lower face of the second diaphram.

22. A portable communication device according to claim 21, further comprising an antenna for receiving radiowaves and a transmission/reception circuit for converting the radiowaves into a voice signal, wherein the electromagnetic transducer reproduces the voice signal.

23. A portable communication device according to claim 16, further comprising a first thin magnetic plate disposed between the first magnet and the first diaphram.

24. A portable communication device according to claim 23, further comprising an antenna for receiving radiowaves and a transmission/reception circuit for converting the radiowaves into a voice signal, wherein the electromagnetic transducer reproduces the voice signal.

25. A portable communication device according to claim 16, wherein the center pole has a diameter which varies along a height direction thereof.

26. A portable communication device according to claim 25, wherein the diameter of the center pole varies in such a manner as to represent a quadratic curve with respect to the height of the center pole.

27. A portable communication device according to claim 26, further comprising an antenna for receiving radiowaves and a transmission/reception circuit for converting the radiowaves into a voice signal, wherein the electromagnetic transducer reproduces the voice signal.

28. A portable communication device according to claim 25, further comprising an antenna for receiving radiowaves and a transmission/reception circuit for converting the radiowaves into a voice signal, wherein the electromagnetic transducer reproduces the voice signal.

29. A portable communication device according to claim 16, wherein the second diaphram has a larger thickness at an inner periphery than at an outer periphery thereof.

30. A portable communication device according to claim 29, further comprising an antenna for receiving radiowaves and a transmission/reception circuit for converting the radiowaves into a voice signal, wherein the electromagnetic transducer reproduces the voice signal.

31. A portable communication device according to claim 16, wherein the second diaphram is turned up or down at an inner periphery thereof so as to have a substantially L-shaped cross section.

32. A portable communication device according to claim 31, further comprising an antenna for receiving radiowaves and a transmission/reception circuit or converting the radiowaves into a voice signal, wherein the electromagnetic transducer reproduces the voice signal.

33. A portable communication device according to claim 16, further comprising a cover for covering the opening in the second diaphragm.

34. A portable communication device according to claim 33, further comprising an antenna for receiving radiowaves and a transmission/reception circuit for converting the radiowaves into a voice signal, wherein the electromagnetic transducer reproduces the voice signal.

35. A portable communication device according to claim 33, wherein the cover is integral with the first diaphragm.

36. A portable communication device according to claim 35, further comprising an antenna for receiving radiowaves and a transmission/reception circuit for converting the radiowaves into a voice signal, wherein the electromagnetic transducer reproduces the voice signal.

37. A portable communication device according to claim 16, further comprising a second magnet provided so as to be on an opposite side of the second diaphragm from the yoke.

38. A portable communication device according to claim 37, further comprising a second thin magnetic plate provided so as to be an opposite side of the second magnet from the yoke.

39. A portable communication device according to claim 38, further comprising an antenna for receiving radiowaves and a transmission/reception circuit for converting the radiowaves into a voice signal, wherein the electromagnetic transducer reproduces the voice signal.

40. A portable communication device according to claim 37, further comprising an antenna for receiving radiowaves and a transmission/reception circuit for converting the radiowaves into a voice signal, wherein the electromagnetic transducer reproduces the voice signal.

41. A portable communication device according to claim 37, further comprising a second housing for supporting the second magnet.

42. A portable communication device according to claim 41, further comprising an antenna for receiving radiowaves and a transmission/reception circuit for converting the radiowaves into a voice signal, wherein the electromagnetic transducer reproduces the voice signal.

43. A portable communication device according to claim 16, further comprising a first housing for supporting the first diaphragm.

44. A portable communication device according to claim 43, further comprising an antenna for receiving radiowaves and a transmission/reception circuit for converting the radiowaves into a voice signal, wherein the electromagnetic transducer reproduces the voice signal.

* * * * *

UNITED STATES PATENT AND TRADEMARK OFFICE

CERTIFICATE OF CORRECTION

PATENT NO. : 6,920,230 B2
APPLICATION NO. : 09/980325
DATED : July 19, 2005
INVENTOR(S) : Sawako Usuki and et al.

It is certified that error appears in the above-identified patent and that said Letters Patent is hereby corrected as shown below:

Column 14

Line 37, number "15" should read -- 16 --.

Signed and Sealed this

Twelfth Day of September, 2006

JON W. DUDAS
*Director of the United States Patent and Trademark Office*